United States Patent [19]

Curtis, III

[11] 4,392,031

[45] Jul. 5, 1983

[54] MINIATURE ELECTRICAL SWITCH

[75] Inventor: Hazen Curtis, III, Andover, Mass.

[73] Assignee: Bell Telephone Laboratories, Incorporated, Murray Hill, N.J.

[21] Appl. No.: 336,325

[22] Filed: Dec. 31, 1981

[51] Int. Cl.[3] ..... H01H 15/02

[52] U.S. Cl. ..... 200/16 R; 200/5 R; 200/6 R; 200/6 B; 200/6 BB; 200/153 LA

[58] Field of Search ..... 200/5 R, 6 R, 6 B, 6 BA, 200/6 BB, 6 C, 16 R, 16 C, 16 D, 16 F, 292, 303, 153 L, 153 LA, 153 LB

[56] References Cited

U.S. PATENT DOCUMENTS

| | | | |
|---|---|---|---|
| 3,849,610 | 11/1974 | Lockard et al. | 200/16 R X |
| 3,917,921 | 11/1975 | Jakubauskas | 200/16 R X |
| 3,963,884 | 6/1976 | Pollock | 200/16 D |
| 3,974,346 | 8/1976 | Keprda | 200/16 D |
| 4,012,608 | 3/1977 | Lockard | 200/16 D |
| 4,191,867 | 3/1980 | Feaster | 200/16 R |
| 4,302,637 | 11/1981 | Ditzig | 200/5 R X |

*Primary Examiner*—J. R. Scott
*Attorney, Agent, or Firm*—Volker R. Ulbrich

[57] ABSTRACT

A dual in-line package miniature electrical switch module has its active members, the contact members and sliding actuators, mounted on a unitary frame member to minimize misalignment problems. The cover serves primarily a protective function. The contacts have integral terminal pins and clamp to an edge of the frame to simplify assembly. A substrate having an electrical circuit pattern applied on one or both major surfaces can be contacted and clamped by the contact members against the bottom of the frame to form an integral switch and circuit module, such as an attenuator switch. Two or more sliding actuators may be rigidly interconnected to form a gang unit.

7 Claims, 6 Drawing Figures

MINIATURE ELECTRICAL SWITCH

FIELD OF THE INVENTION

The invention relates generally to make-or-break electrical switches and, more particularly, to miniature switch modules designated to be mounted on circuit boards.

BACKGROUND OF THE INVENTION

Miniature electrical switch modules are commonly pin-compatible with, and mounted on circuit boards. They provide a means for setting a particular circuit configuration in generalized circuits which may be adapted to a particular function, such as resistor networks, attenuators, and slope equalizers used in telecommunication equipment.

These switch modules can have significant unreliability, typically in the failure to make proper contact in the closed position. The failure most often is a result of the misalignment of various interacting elements of the switch due to improper assembly or mismatched dimensions.

SUMMARY OF THE INVENTION

The electrical switch module in accordance with the present invention has a structure in which a unitary frame member inside a housing is divided into sections by partitions which define a plurality of chambers. The chambers are each adapted to receive and position in alignment a matched set of contact-terminal members. The upper parts of adjacent partitions defines a slot adapted to receive an actuating slider for engaging and disengaging the contact-terminal members. The frame member is a unitary molded member which provides a single mounting structure for determining the alignment of all the active elements of the switch module to thereby improve the reliability and reduce the cost of assembly. One or more circuit substrates may be clamped under the frame and contacted by terminal clamps to become an integral part of the module.

DESCRIPTION OF THE PREFERRED EMBODIMENT

Figure 1:
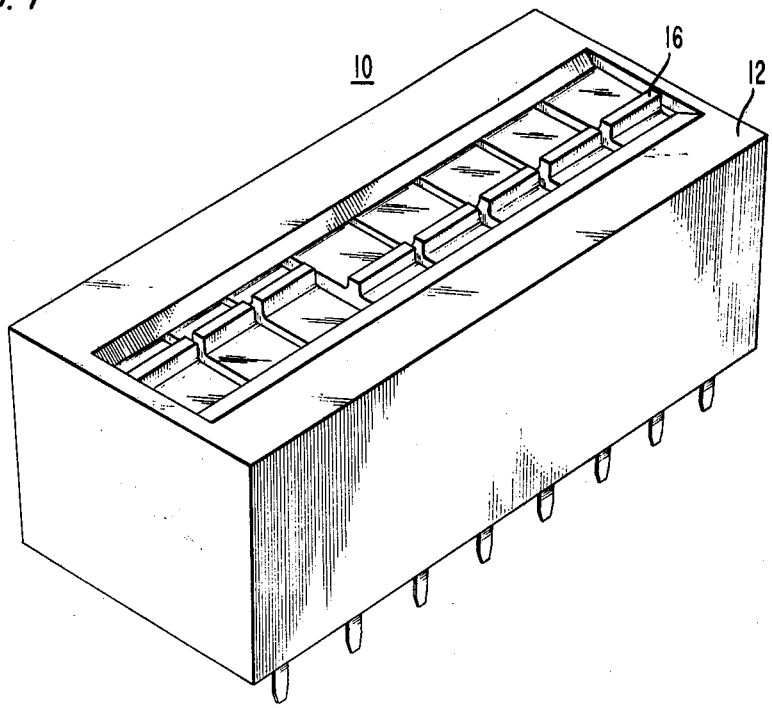
FIG. 1 is an elevated end perspective of a miniature switch module in accordance with a preferred embodiment of the present invention.
Figure 2:
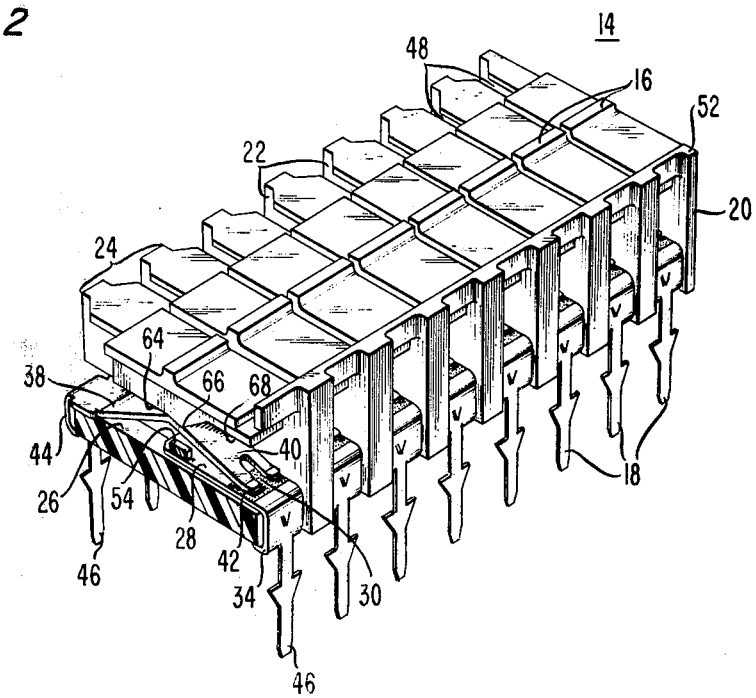
FIG. 2 is an elevated, transversely sectioned perspective view of the switch of FIG. 1 with the cover removed to show the internal frame and contact assembly.

The device shown in FIG. 1 of the drawings is an eight-section pin-compatible miniature electrical switch module 10 for circuit board mounting, generally known as a "DIP (dual in-line package) miniature switch". It has a cover 12 over a frame and contact assembly 14, shown separately in FIG 2, having a set of actuating sliders 16 exposed by an opening in the top of the cover 12 and a set of pin terminals 18 extending from the bottom. The dimensions and spacing of its pin terminals 18 are compatible with receiving openings in commonly used commercially available circuit boards.

The frame and contact assembly 14 of the switch module 10 is shown sectioned transversely near one end to reveal the other assembled elements. The assembly 14 includes a frame 20 of molded phenolic resin which is divided into a plurality of sections, each having a transverse chamber 22 defined by adjacent partitions 24 extending from a planar base 26 which forms the floor of the chambers 22.

Resiliently clamped to one edge of the base 26 and extending along the base 26 into each of the chambers 22 is an anvil terminal member 28 having an anvil contact area 30 on a flat tongue portion lying on the base 26. The member 28 is held in place by a clip portion 34. Resiliently clamped to the opposite edge of the base 26 at each of the chambers 22 is a spring contact blade terminal member 38 having a blade 40 extending partially over the anvil terminal member 28 and having a contact surface 42 directly opposite the anvil contact area 30. The blade terminal member 38 is likewise held in place by a clip portion 44. An integral terminal pin 46 extends downward from each of the clip portions 34, 44 of the terminal members 28, 38.

The partitions 24 of the frame 20 have a generally T-shaped transverse cross-sectional configuration and thereby define for each chamber 22, by their mutually spaced, opposing edges, a slot 48 adapted to receive a polyester slider 16 for actuating the spring contact member 38. The sliders 16 may be inserted from one side of the frame 20 and are provided with a stop rail 52 at the other side of the frame 20. Each of the sliders 16 has on its underside a cam surface which includes a low, closed contact plane portion 64, a peak portion 66, and a high, open contact portion 68.

Figure 3:
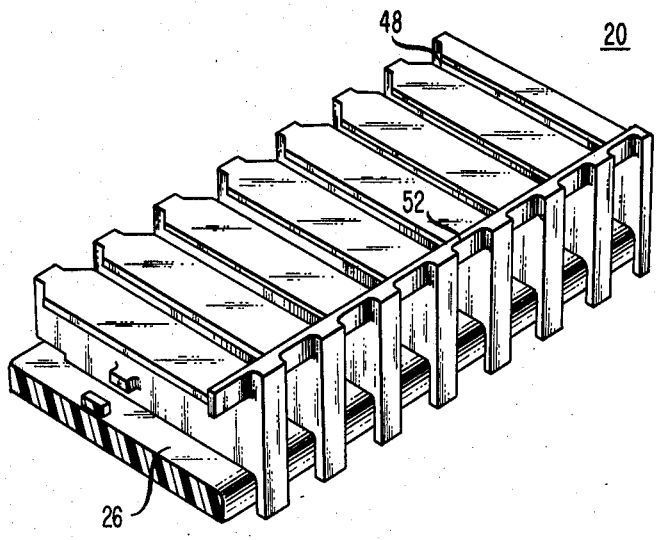
FIG. 3 is an elevated, transversely sectioned perspective view of only the frame of the assembly of FIG. 2.

The frame 20 is shown separately in FIG. 3. It is a unitary injection-molded piece. This makes it possible for the alignment tolerances for all active members within the switch module 10—that being the sliders 16 and the terminals 18-to be determined by only a single member to thereby avoid misalignment problems arising from dimensional mismatches or misassembly of two or more members carrying active elements.

The partitions 24 between the chambers 22 have on their surfaces near their base 26 an opposing pair of bosses 54 closely spaced from the base 26 to hold anvil terminal members 28 in place against the base 26. The stop rail 52 for the sliders 16 is also a part of the frame 20. It provides longitudinal rigidity for the frame 20 and simplifies the assembly of the sliders 16 in their slots 48.

GENERAL CONSIDERATIONS

Figure 4:
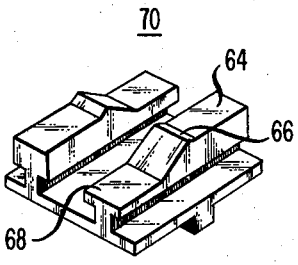
FIG. 4 is an elevated perspective of the underside of a pair of actuating sliders in a gang configuration for use in the switch module of FIG. 1.

The sliders 16 are constructed so that they may be inserted into the frame 20 facing in either direction, so that their cam surfaces may establish either an open or a closed position for the contact spring member 38 as desired for any particular section chamber 22. Moreover, two or more of the sliders 16 may be formed as a gang unit to assure their simultaneous operation. In FIG. 4 there is separately illustrated a double slider unit 70 which is inverted to show the cam surfaces oriented in mutually opposite directions. When the slider unit 70 is installed in the switch module 10 and operated from one position to the other, the spring contact member 38 associated with one of the sliders 16 of the unit 70 will be brought into a closed switch position, while the spring contact member 38 associated with the other of the sliders 16 of the unit 70 will be brought into an open position. Any number of the sliders 16 of the module 10 may be so formed together as a unit to establish a predetermined switching pattern when operated. A switch module may have any desired number of sections.

The cam surfaces of the sliders 16 are so contoured that as the spring contact member 38 is being brought into the closed position, the peak 66 causes it to first overshoot this position and then return to it. This wipes the contact surfaces 30, 42 against each other to provide cleaning of their surfaces for assuring reliable electrical contact and also provides a latching of the slider 16 in the closed position.

Figure 5:
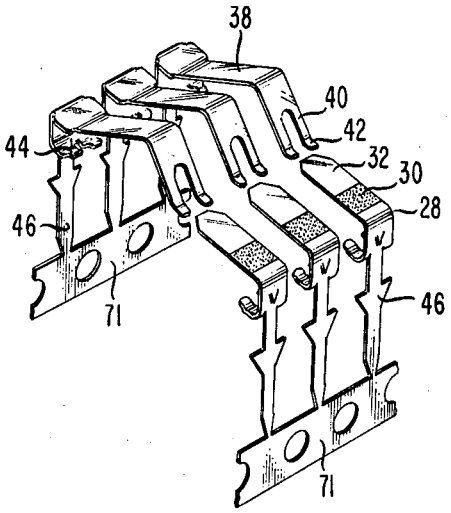
FIG. 5 is an elevated perspective of matching segments of terminal strips holding matching contact terminal members for assembly into the frame of FIG. 3.

It is an advantageous feature of the switch module 10 that the contact terminal members 28, 38 may be assembled and fastened to the frame 20 from the sides, without having to be inserted through any openings. This permits the terminal members 28, 38 to be assembled readily as interconnected strips, as shown in FIG. 5. After attachment of the members 28, 38 to the frame 20, the connecting strips 71 can be severed. This greatly reduces the manufacturing problems associated with individual handling of the terminal members 28, 38 and reduces their cost.

The terminal members 28, 38 themselves are of beryllium copper and are designed to undergo plastic deformation on their first operation after assembly to take a final set best suited for their resilient function in the switch. It is an advantage of beryllium copper terminals that after they have been formed it is not necessary to further heat treat them to provide the required resilience.

Figure 6:
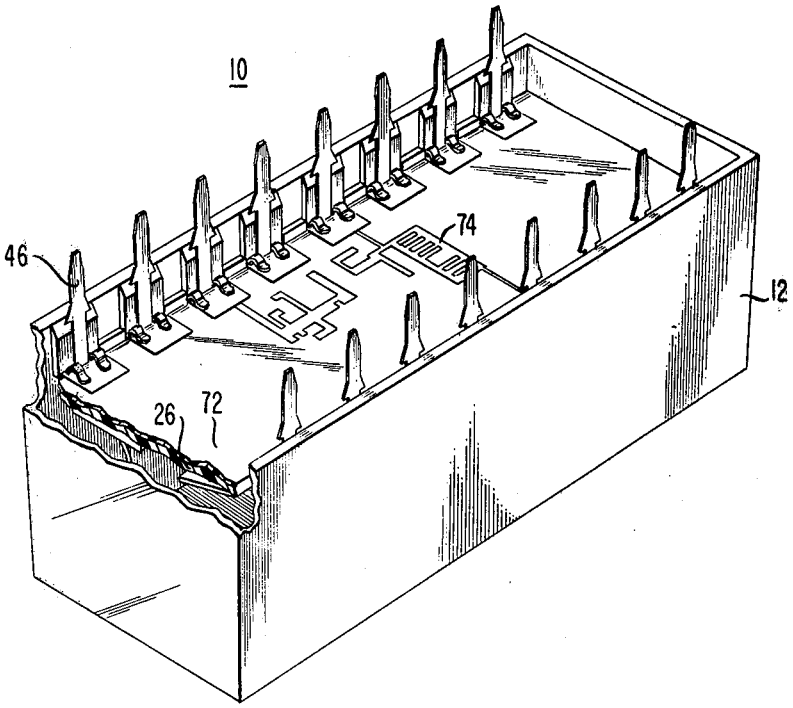
FIG. 6 is an elevated partially exposed perspective view of the underside of a longitudinal fragment of a switch-attenuator assembly in accordance with another embodiment of the invention.

FIG. 6 shows a ceramic attenuator circuit substrate 72 positioned adjacent the bottom face of the base 26. The substrate 72 has a circuit pattern 74 applied on both of its major surfaces. It is held in place by the clip portions 34, 44 of the terminal members 28, 38. The clip portions 34, 44 make appropriate contact to elements of the circuit substrate 72 to provide an integral switch-resistor, switch-attenuator or other module. Since the circuit substrate 72 also provides structural reinforcement of the base 26, the thickness of the base 26 is shown correspondingly decreased.

What is claimed is:

1. An electrical slide switch of the type having a cover which leaves exposed one or more sliders for actuating make-or-break contact members inside the switch, CHARACTERIZED IN THAT said switch comprises under said cover a unitary frame member having a base which forms a floor and having at least two partitions extending from said base to form between them at least one chamber for receiving said contact members, said partitions being adapted at their free edges remote from said floor to form a slot for holding and guiding said sliders, said contact members comprising a spring member which is pressed against an anvil member by action of a cam surface on said slider engaging a cam-follower surface of said spring member, and said contact members each including a clip portion by which they are resiliently held to the edge of said base.

2. The switch in accordance with claim 1 wherein said contact members include integral terminal pins extending in a direction away from said base.

3. The switch in accordance with claim 2 comprising a substrate having a circuit pattern on at least one major surface mounted against the outer surface of said base and resiliently held by said clip portions of said contact members.

4. The switch in accordance with claim 3 wherein said terminal pins comprise tab members for fastening said switch to a circuit board.

5. The switch in accordance with claim 4 wherein said clip portions make electrical contact to circuit terminal contact areas provided on said substrate.

6. The switch in accordance with claim 5 wherein said slider cam surface includes portions which cause contact overshoot and slider latching.

7. The switch in accordance with claim 5 comprising at least two sliders rigidly interconnected to form a gang unit.

* * * * *